US005140117A

United States Patent [19]

Vianson

[11] Patent Number: 5,140,117

[45] Date of Patent: Aug. 18, 1992

[54] TWO-LINK, TRIP-FREE MECHANISM FOR USE IN A SWITCH ASSEMBLY

[75] Inventor: Paolo M. Vianson, Fremont, Calif.

[73] Assignee: PMC Engineering Company, Inc., Livermore, Calif.

[21] Appl. No.: 662,220

[22] Filed: Feb. 28, 1991

[51] Int. Cl.[5] ..... H01H 5/00; H01H 73/00

[52] U.S. Cl. ..... 200/400; 200/401; 335/190

[58] Field of Search ..... 200/400, 337, 401; 335/190, 192, 185

[56] References Cited

U.S. PATENT DOCUMENTS

| | | | |
|---|---|---|---|
| 3,089,011 | 5/1963 | Alexandersson | 335/190 |
| 4,167,659 | 9/1979 | Yamanaka et al. | 200/401 |
| 4,472,615 | 9/1984 | Itoh et al. | 200/401 |
| 4,578,551 | 3/1986 | Lin | 200/400 |
| 4,791,250 | 12/1988 | Yin | 200/17 R |

FOREIGN PATENT DOCUMENTS

| | | | |
|---|---|---|---|
| 402543 | 7/1966 | Australia | 200/400 |

*Primary Examiner*—Renee S. Luebke

*Assistant Examiner*—David J. Walczak

*Attorney, Agent, or Firm*—Patrick T. King

[57] ABSTRACT

A two-link, trip-free operating mechanism assembly for a switch includes a first pivotally-mounted link comprising a switch lever arm. One end of the switch lever arm is coupled to the switch and a second end of the switch lever arm has a roller mounted thereto. A second link assembly includes a pivotable support member to which a cam member is mounted for rotation. The pivotable support member is selectively fixed during the closing of the contacts, or movable between a contact-closed position and an overriding open position. The cam member controls the state of the switch. In the tripped condition, the cam member and the roller are disengaged and the switch assumes a tripped, or open, state. A first spring arrangement applies a force to the link arrangement to cause the links to close from an open position. For trip-free operation, a second set of springs forces the switch arm link to immediately move to a switch-open position. The trip-free operation functions so that the switch assembly can be tripped back to its open position at any time.

6 Claims, 11 Drawing Sheets

TWO-LINK, TRIP-FREE MECHANISM FOR USE IN A SWITCH ASSEMBLY

BACKGROUND OF THE INVENTION

1. Field of the Invention

This invention relates to electrical switch assemblies and, more particularly, to a two-link, trip-free mechanism especially useful in a high-voltage circuit breaker.

2. Prior Art

Circuit breakers generally are well known in the art and are used with a wide range of voltage levels. Circuit breakers are also used in high and ultra high voltage circuits, having voltages for example on the order of 25,000 volts, as part of the protective and safety equipment for a circuit. For use with these types of circuits, it is essential that the circuit breaker itself be trip-free in any operating position.

Trip-free means that, whether the circuit breaker is free to be tripped, or have its contacts opened, in any operating configuration of the breaker. Tripping can occur when the breaker is in its contacts-closed configuration and even during the switch-closing sequence for the switch. Either the protective and safety equipment for the circuit or an operator must be able to open the contacts at any instant and override the switch-closing sequence, if necessary, causing the circuit breaker to immediately trip open and interrupt the circuit.

In order to achieve the objective of having a circuit breaker be trip-free, a typical design for a circuit breaker mechanism utilizes several links interconnected together to move the switch contacts of the circuit breaker to their open or closed positions.

While it is highly desired in this field to provide circuit breaker mechanisms which are able to perform in a trip-free manner, the typical prior-art link arrangement for circuit breaker mechanisms are relatively complicated, requiring at least three links. Such a prior-art three-link arrangement is disclosed in U.S. Pat. No. 4,791,250, granted Dec. 13, 1988.

FIG. 1A and FIG. 1B schematically illustrate another prior-art three-link circuit breaker mechanism assembly 10. FIG. 1A shows the three-link mechanism in a tripped, open-contact position. FIG. 1B shows the three-link mechanism in a non-tripped, closed-contact position. The circuit breaker mechanism includes a conventional high-voltage electrical switch having a fixed contact 12 and a movable contact 14, both of which are adapted for use in a high voltage circuit. The assembly 10 includes a three-link arrangement consisting of links L1, L2 and L3. Link L3 is mounted for pivotal movement by a suitable rotatable, or revolute, joint 22, which is mounted in a fixed position as indicated in the drawing. The link L3 is connected at one end to the movable switch contact 14 by another revolute joint 26. The other end of the link 20 is connected to one end of a connecting link L2 by a revolute joint 28. The opposite end of the connecting link L2 is coupled to link L1 by another joint arrangement, which includes a roller 30 mounted to the end of the connecting link L2. The roller 30 is constrained to stay within a slot 32 as it contacts a cam end 34 of the link L1. Latch 36 prevents slot 32 from moving rightwardly, therefore maintaining the contact between roller 30 and cam end 34 of link L1. Latch 36 is the trip latch, while latch 44 is the closing latch, which prevents L1 from rotating.

Link L1 is supported at its other end by a revolute fixed joint 38, which is mounted to a fixed support 40.

FIG. 1A shows the other prior-art, three-link mechanism with its switch contacts in an open position. Link L1 has a downward force, as indicated by FA, exerted on it by a spring 42. The link L1 is restrained from movement caused by the force FA by a releasable latch mechanism, as indicated by reference numeral 44. Force FA, when released, pivots the link 16 in a clockwise direction as indicated by arrow 45 in FIG. 1B. The force FA is coupled through the connecting link L2 to pivot the link L3 and close the switch contacts 12,14.

FIG. 1B shows the other prior-art three-link mechanism with its switch contacts in a closed position. Link L3 has a switch-opening upward force, as indicated by FB, exerted on it. This force FB is provided by a spring arrangement 46. The force FB, when released causes the switch contacts 12, 14 to be in an open position.

This other three-link arrangement provides a trip-free capability by permitting the connection as provided by the revolute joint using roller 30 between links L1 and L3 to be defeated. By freeing latch 36, the connection between link L1 and connecting link L2 is broken. The link L3 is rotated counterclockwise by the force FB of the spring arrangement 46, which results in the opening of the switch contacts 12, 14.

The foregoing description of a prior art type of circuit breaker utilizes three links to provide a trip-free, immediate override capability to the circuit breaker mechanism 10. This permits the contacts to be opened at any time during a switch-closing operation of the circuit breaker. It is to be understood that only certain components of the overall circuit breaker pertinent to the present discussion have been illustrated and that other components have been omitted for clarity.

While this particular trip-free design appears to function in a satisfactory manner, it does require the use of three links, which makes it a relatively complicated device from a structural standpoint. Nevertheless, the applicant is not aware of any heretofore available link-type of circuit breaker which does not utilize at least three links in order to provide the desired trip-free, override capabilities. Consequently, a need exists for a less complex, two-link circuit breaker.

SUMMARY OF THE INVENTION

It is therefore an object of the invention to provide a design of an operating mechanism for a trip-free circuit breaker mechanism which utilizes only two links, where one of the links is connected to the switch contacts movable between an open position and a closed position.

In accordance with this and other objects of the invention, a two-link, trip-free operating mechanism for use with a switch assembly is provided according to the invention. The operating mechanism includes a switch means movable between a tripped, or open, state and a closed state. The mechanism functions to provide the switch in an open or a closed state. The mechanism according to the invention includes only two-links with the capability to allows the switch to be opened in a truly trip-free manner, that is at any time in the operating cycle of the switch. For example, some prior art breaker do not allow switch to be opened when the mechanism is changing the switch from an open to a closed configuration.

The two-link arrangement according to the invention includes a first link member, which is a switch lever arm mounted for pivotal movement about a first fixed pivot point and moving between a non-tripping position and a switch-tripping position. The switch lever arm has one end coupled to the switch and moves the switch between a tripped state and a closed state. A cam-follower, for example, a roller, is mounted to the other end of the switch lever arm. Biasing means, for example switch-opening springs, are provided for biasing the switch end of said lever arm to a switch-tripping position.

A second link member is provided which has a cam member rotatably mounted on it. In the normal mode of operation, the cam member engages the cam-follower and is rotatable to various positions to move the cam-follower to various positions to control the state of the switch between the opened of the closed state. This second link member is mounted on a support which can be selectively fixed or pivotable about a second pivot point.

In an overriding trip-free mode of operation, this second pivot point is moved to release the cam-follower from engagement with the cam, permitting the switch-opening springs to immediately open the switch contacts independent of the rotational position of the cam. Consequently, means are provided for translating this second pivot point for the cam member, which provides for selectively engaging and disengaging the cam with the cam-follower.

BRIEF DESCRIPTION OF THE DRAWINGS

The accompanying drawings, which are incorporated in and form a part of this specification, illustrate embodiments of the invention and, together with the description, serve to explain the principles of the invention.

DETAILED DESCRIPTION OF THE PREFERRED EMBODIMENTS

Reference will now be made in detail to the preferred embodiment of the invention, an example of which is illustrated in the accompanying drawings. While the invention will be described in conjunction with the preferred embodiment, it will be understood that it is not intended to limit the invention to that embodiment. On the contrary, the invention is intended to cover alternatives, modifications and equivalents, which may be included within the spirit and scope of the invention as defined by the appended claims.

Figure 1A:
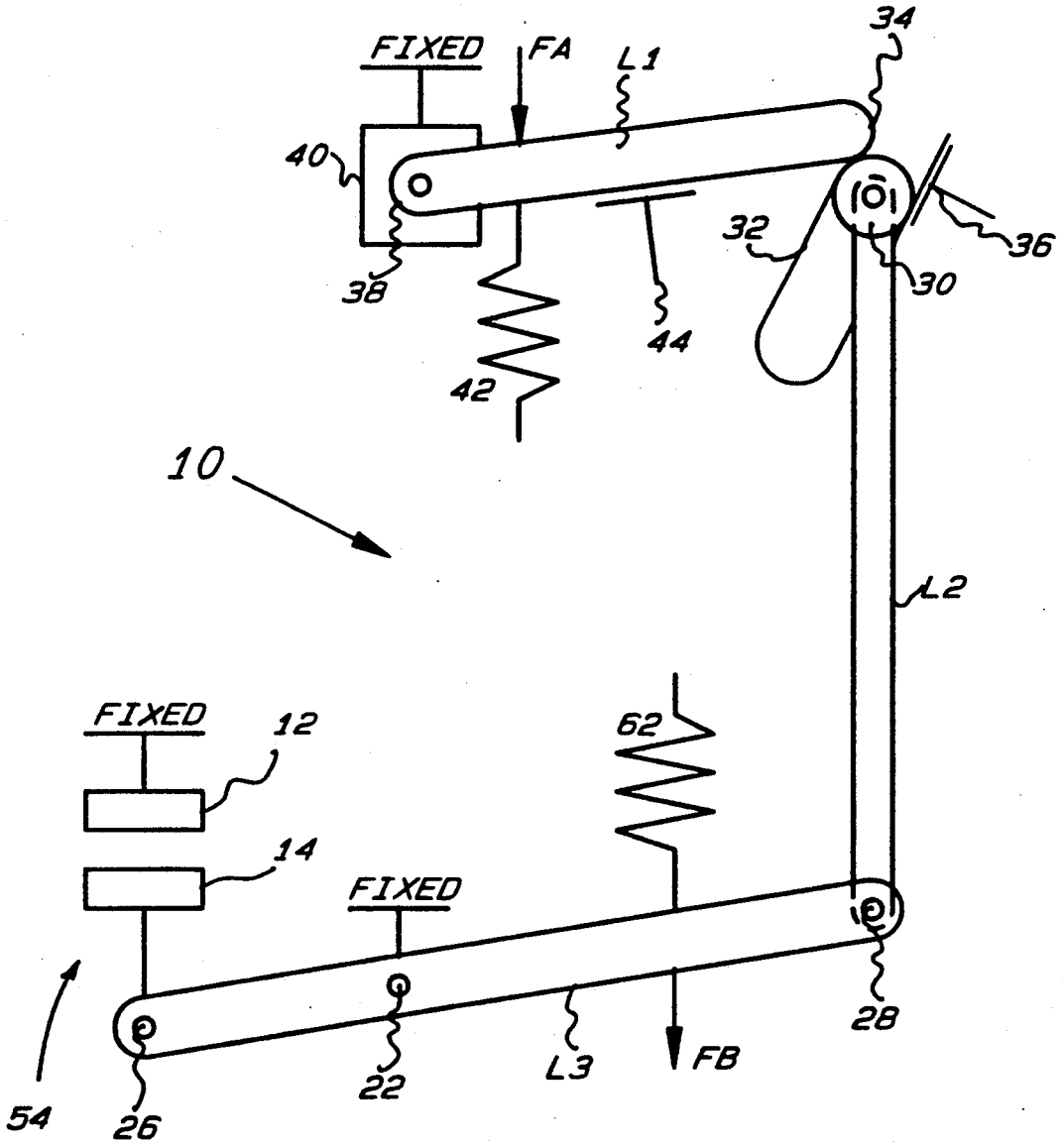
FIG. 1A (PRIOR ART)
FIG. 1A is a diagrammatic illustration of a prior-art, three-link type of circuit breaker mechanism, shown in its switch-open operating configuration.
Figure 1B:
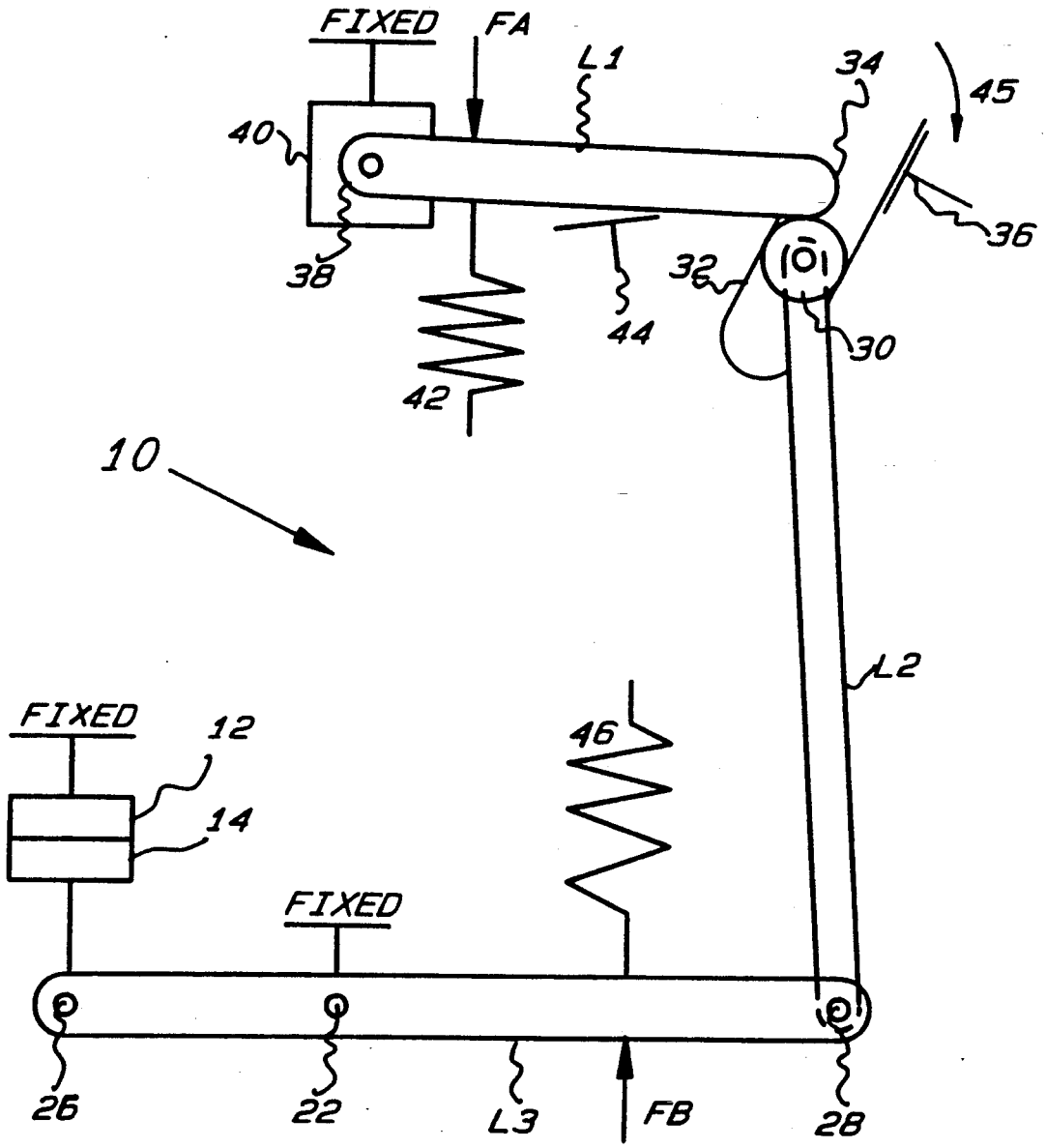
FIG. 1B (PRIOR ART)
FIG. 1B is a diagrammatic illustration of the prior-art, three-link circuit breaker mechanism of FIG. 1A, shown in its switch-closed operating configuration.

FIGS. 1A and 1B have already been described in connection with the discussion of a prior-art, three-link circuit breaker.

Figure 2A:
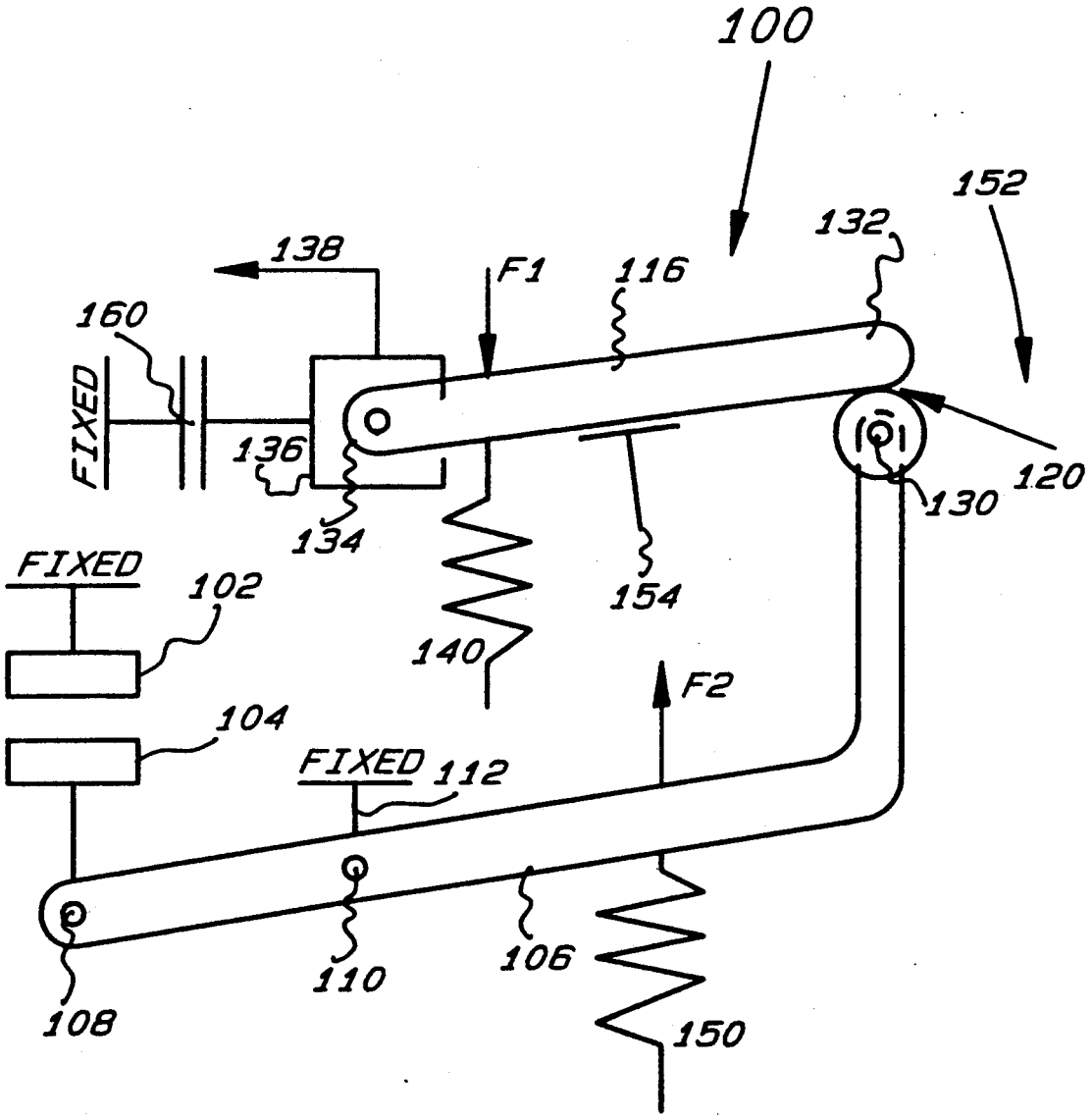
FIG. 2A is a diagrammatic illustration of a circuit breaker employing a mechanism designed in accordance with the present invention and shown in its switch-open operating configuration.

FIG. 2A shows an overall assembly 100 of a two-link, trip-free mechanism for operating a switch, where the switch includes a fixed electrical contact 102 and a movable contact 104. The switch is shown in the switch-open configuration. The movable contact 104 is connected to a first link, or switch lever arm, 106 by means of revolute joint 108. The switch lever arm 106 is mounted for pivotal movement on a revolute joint 110 which is mounted on a fixed support member, as indicated by reference numeral 112. The other end of the first link, or switch lever arm, 106 is connected to a second link 116 by means of a joint 120, which is shown as a roller 130, which rolls on a cam end 132 of the link 116. The other end of the link 116 is mounted for pivotal movement about a revolute joint 134 on a movable support 136, which can move in the direction indicated by the reference numeral 138.

As illustrated in FIG. 2A, the assembly 100 includes two spring assemblies: a driving spring assembly 140 and a returning spring assembly 150. Driving spring assembly 140 exerts a downward switch-closing force F1 on the link 116 to rotate the link 116 clockwise as indicated by reference arrow 152. The link 116 is prevented from rotating clockwise by a latch 154, which is referred to as a closing latch. An electrical motor and a manual means, not shown, is provided for the charging of the spring assembly 140, as will be discussed in connection with the specific embodiment of the invention disclosed in connection with FIGS. 3 through 8.

The returning spring assembly 150 exerts an upward switch-opening force F2 on the switch arm 106, biasing this link member to a contact-open configuration. This spring assembly 150 is charged by the clockwise rotation of link 116 when the mechanism moves to a contact-closed configuration.

In addition to the components thus far described, the two-link, trip-free mechanism assembly 10 includes a tripping latch mechanism as indicated by reference numeral 160, which is shown engaged with the movable support 136. For closing of the switch, the closing latch 154 is released to permit the link 116 to rotate in the clockwise direction as indicated by the reference arrow 152

Figure 2B:
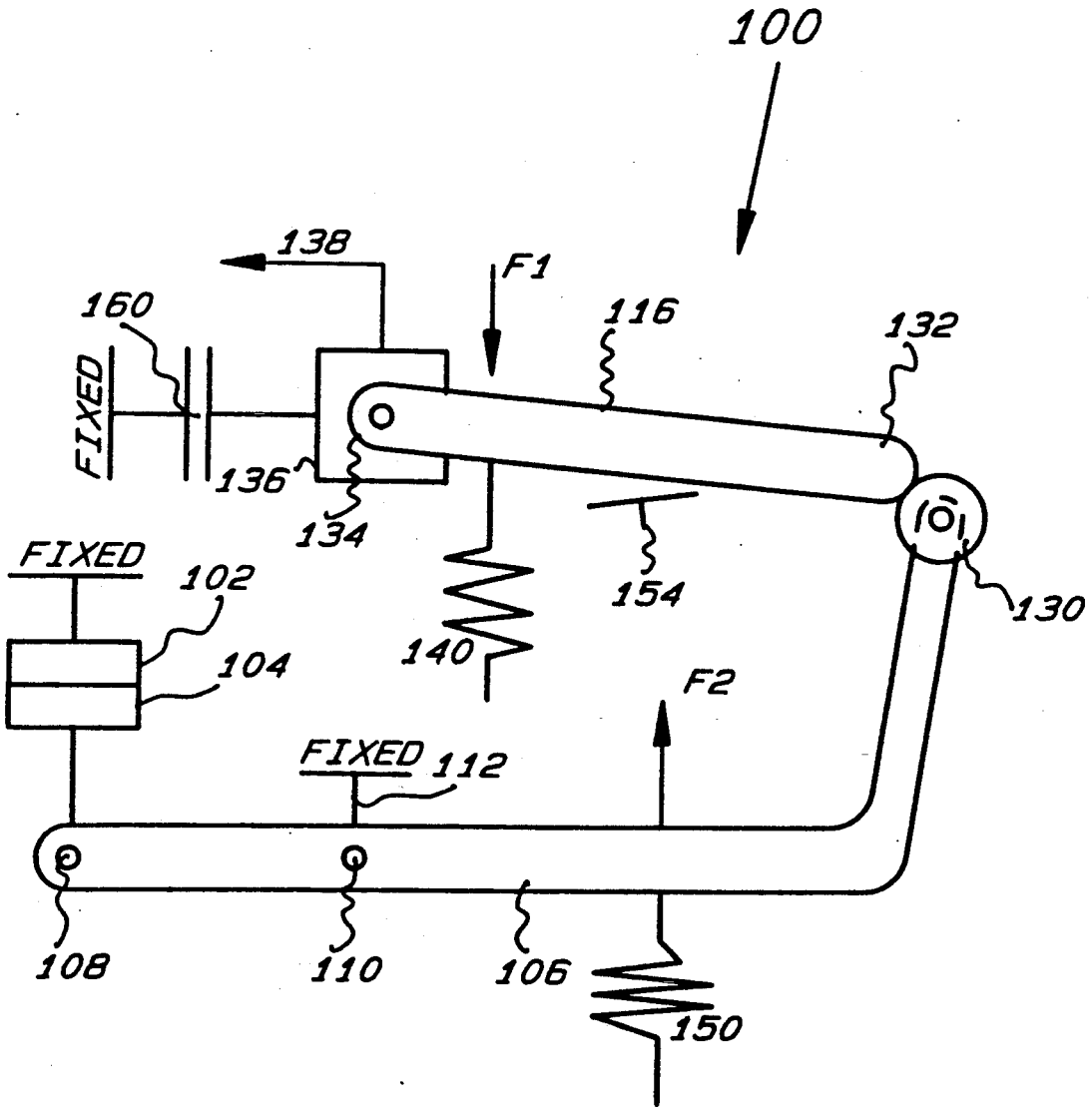
FIG. 2B is a diagrammatic illustration of the circuit breaker of FIG. 2A shown in its switch-closed operating configuration.
Figure 2C:
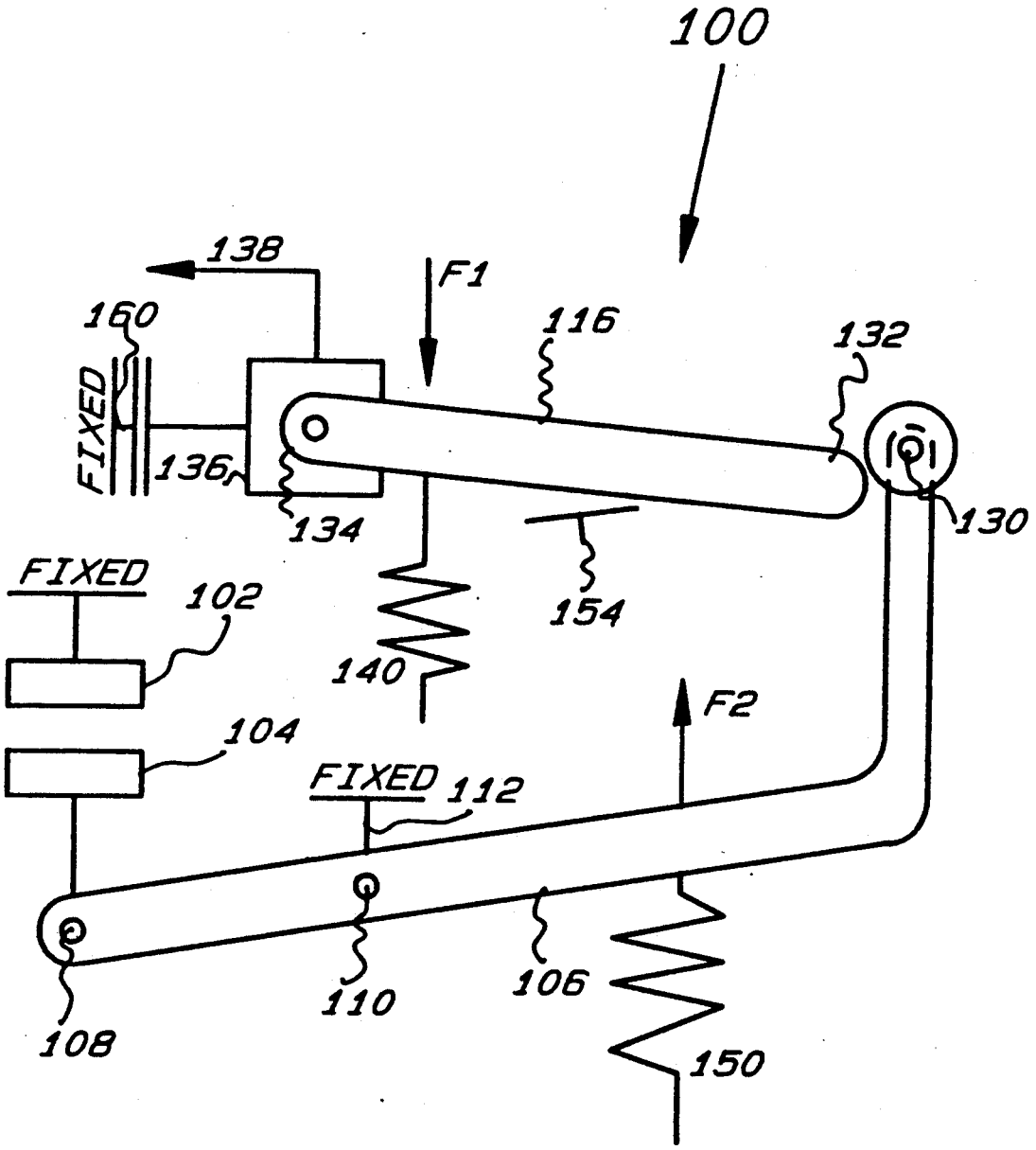
FIG. 2C is a diagrammatic illustration of the circuit breaker of FIG. 2A shown in its tripped operating configuration.

FIG. 2C shows that the tripping latch 160 is released to permit the now movable support means 136 to move in the direction of the reference arrow 138 and to disengage the cam end 132 of the link 116 from the roller 130. The tripping latch 160 is designed to provide a trip-free override capability for the mechanism 100 so that the circuit breaker contacts 102,104 can be opened at any time. Means are provided for disengaging the closing latch 154 from the link 116 and for disengaging the tripping latch 160 from the fixed-movable support means 136, as described hereinbelow in connection with FIGS. 3 through 8.

SWITCH CLOSURE SEQUENCE

Having described the basic components of a two-link, trip-free mechanism assembly 100, what is next described is the sequence of actions by which the circuit breaker mechanism moves from a state of open contacts, as shown in FIG. 2A, to a state of closed contacts, as shown in FIG. 2B.

As previously mentioned, the mechanism assembly uses means for manually or electrically charging the driving spring assembly 140. It is assumed that, as shown in FIG. 2A,,the circuit breaker has the driving spring 140 in a charged state, the two links 106,116 engage one another, and the switch contacts 102, 104 are stationary in an open position.

In order to start the closing sequence, the closing latch 154 is disengaged. Link 116 at that time is pushed downward by the switch-closing force F1 and is free to rotate clockwise about joint 134 in the direction of reference arrow 152. This rotation of the end 132 of the link 116 forces the roller 30 mounted to one end of the link 116 to move downwardly, which causes the switch lever arm 106 to rotate clockwise by about joint 110. The other end of the switch lever arm 106 moves upwardly to close the switch contacts 102,104. This closing sequence is possible because the energy available from the switch-closing force F1 of spring 140, which is discharged during the closing process, is always greater than the energy supplied by the force F2 provided by the return spring 62.

At this point, the circuit breaker mechanism 100 and the switch contacts 102,104 are in a closed position with the driving spring 140 in a discharged state. The driving spring assembly 140, which reached a discharged condition during the closing sequence, can be recharged. This recharging can be effected, as will be described hereinafter, without affecting the status of the links or the closed switch contacts. Having the driving spring 140 in a charged condition enables the switch mechanism 100 to rapidly start a new closing sequence, if required. This capability to rapidly start a new closing sequence is particularly desirable in high voltage circuit breakers, where rapid reclosing of a switch is required after the switch contacts are opened for some particular reason.

TRIP-FREE SWITCH OPENING SEQUENCE

It will be now assumed that the switch contacts 102,104 are closed and that the mechanism assembly is in the configuration as shown in FIG. 2B. Attention is focused on the trip-free operation of the switch mechanism by which the switch mechanism assembly 100 moves from a configuration of closed-switch contacts to one of open-switch contacts.

As previously described, this overriding, trip-free switch-opening action can be started at any moment or in any position of the switch-operating mechanism. As explained hereinbelow, the switch-opening action does not depend on whether the driving spring assembly 140 is in either a charged or a discharged condition.

To start a trip-free switch-opening sequence, the tripping latch 160 is moved in the direction of reference arrow 138 and out of engagement with the support 136, which had previously been fixed in position. The switch-opening force F2 from spring assembly 150 tends to rotate the switch contact arm, or link, 106 counter-clockwise, thereby biasing the roller 130 at the end of the switch lever arm 106 upwardly and leftwardly against the cam end 132 of the link 116. The link 116, Which is connected to the now movable support 136 by the revolute joint 134 has a leftwardly directed force component applied to it by the roller 130. Since the now movable support 136 is disengaged from the opening latch 160, the support 136 starts moving to the left, as indicated by the reference arrow 138. The switch arm link 106 can now rotate counterclockwise on the joint 110 so that the movable contact 104 moves downwardly to open the switch circuit.

FIG. 2C shows the cam end 132 and the roller 130 disengaged with the switch contacts 102,104 opened. It is important to note that, in the trip-free switch-opening sequence, the link 116 has no kinematic or dynamic role other than that of transmitting the leftward-pushing force component of the roller 130 to the movable support 136, which is free to move. Therefore, we can assume that during the opening sequence the link 116 is rigidly connected to the support 136 and physically part of it.

SWITCH RECLOSURE SEQUENCE

Assume that the switch-closing, or driving, spring assembly 140 is charged again in a manner to be described hereinbelow. Also assume that the link 116 is in the original position as shown in FIG. 2A. The switch-operating mechanism is ready to reclose its contacts again, as described hereinabove.

It is important to note that the tripping latch 160 can be moved out of engagement with support 136 at any time during the closing process and not only after the switch contacts 102,104 have reached their closed state. That is, assuming we can free the link 116 after a clockwise rotation generated by the closing energy of force F1. If the tripping latch 160 is moved out of engagement with the support 136, the link 116 moves rigidly with the support 136 to the left. This allows the switch arm link 106 to rotate counterclockwise by the upward force F2 to reopen the contacts 102,104.

Having analyzed the opening and closing sequences, it is clear that the above-described, trip-free switch-operating mechanism uses only two links in a relatively uncomplicated design to achieve trip-free operation, independent of the closure status of the switch contacts and the position of the links.

A SPECIFIC EMBODIMENT OF THE INVENTION

A more-detailed, specific embodiment of the present invention is illustrated in FIGS. 3 through 8 and described hereinbelow.

Figure 3:
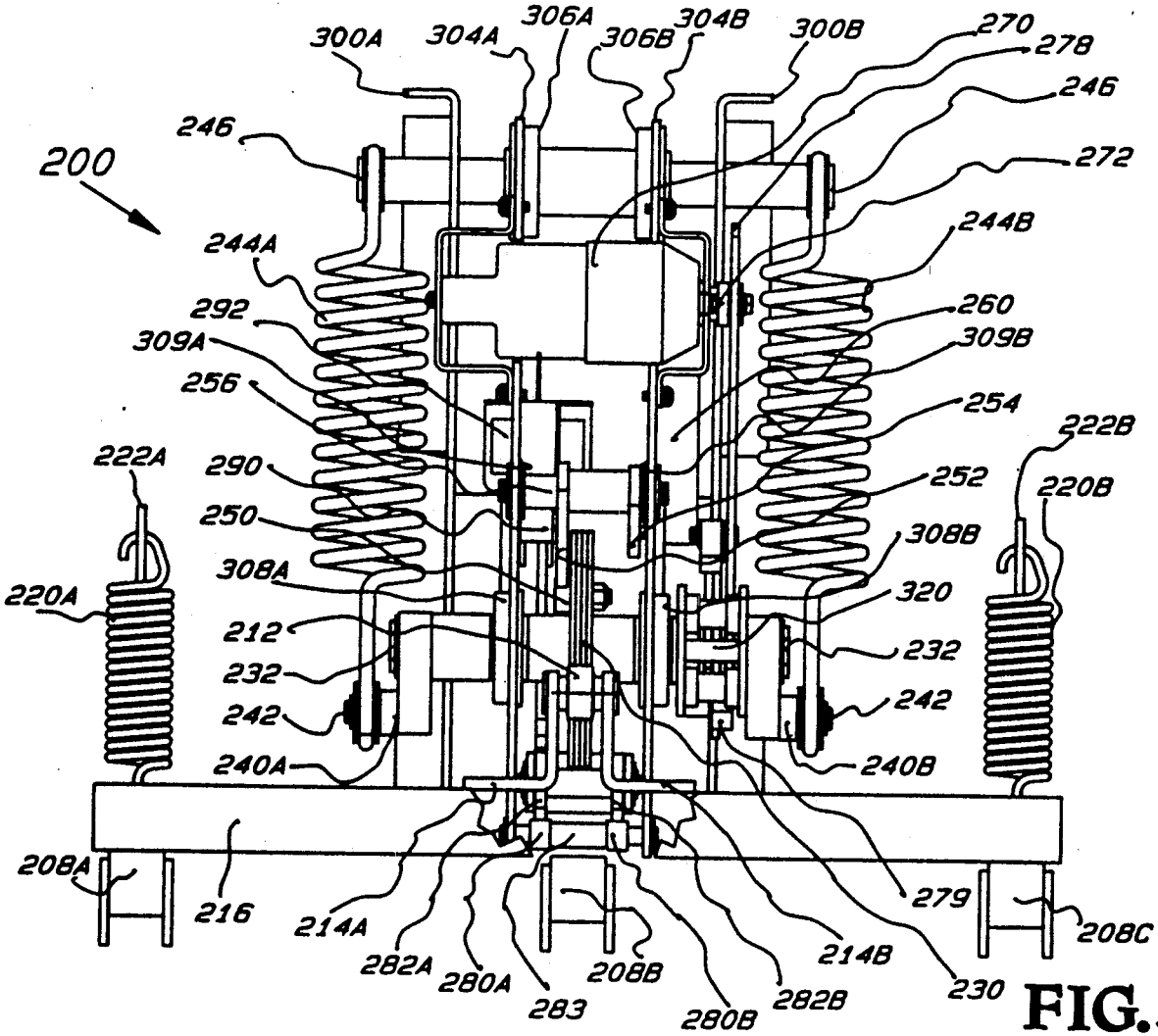
FIG. 3 is a front elevation view of a more detailed embodiment of the circuit breaker mechanism according to the invention.

FIG. 3 is a front elevation view of the switch operating mechanism assembly 200. FIG. 3 shows that the switch operating mechanism 200 has symmetrical pairs of certain elements for distributing and balancing forces in the mechanism.

Figure 4:
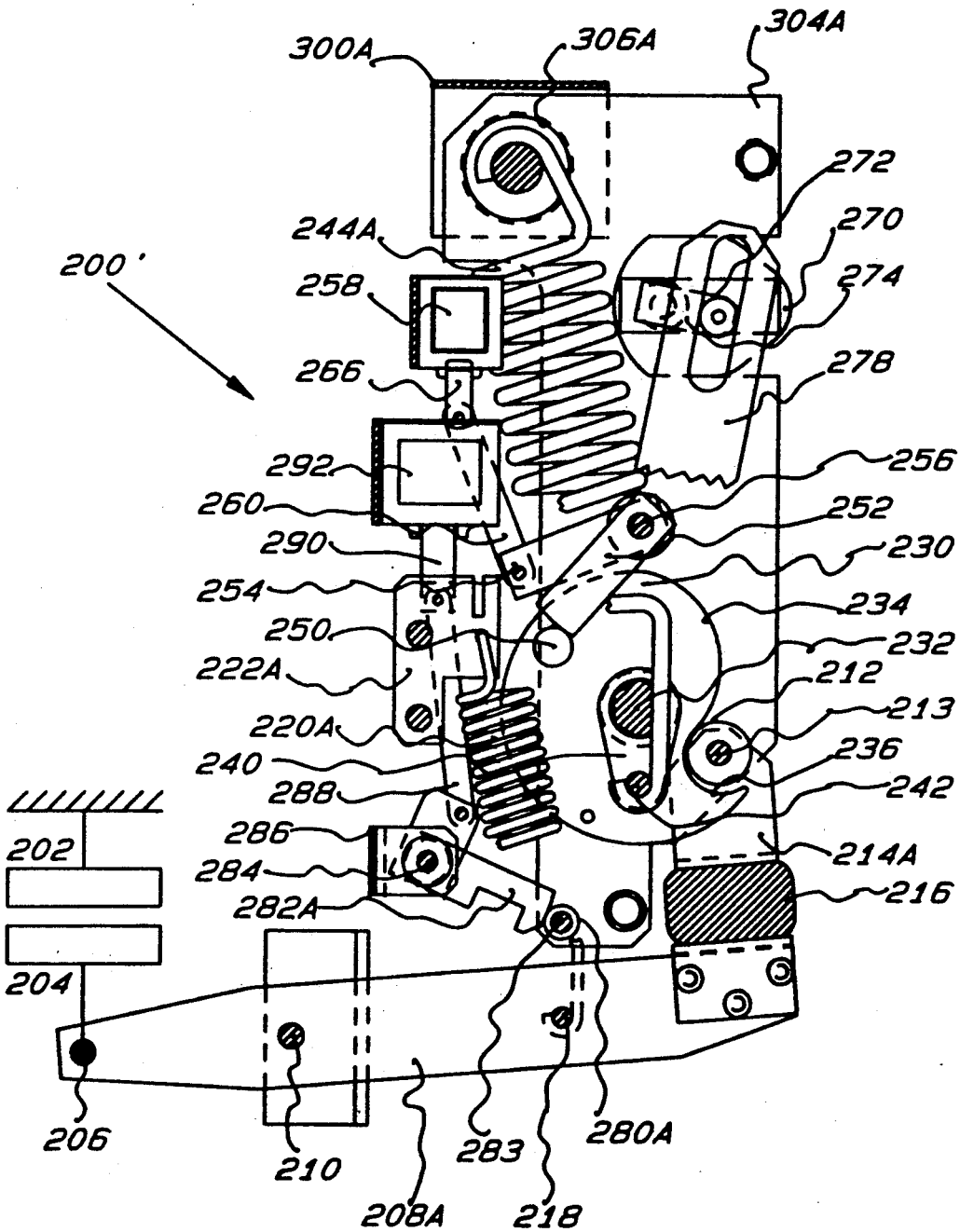
FIG. 4 is a side elevation view of the embodiment of the circuit breaker shown in FIG. 3, with the mechanism and contacts being shown in their open-contact position and with the driving springs in an energized state.

FIG. 4 shows a more detailed embodiment of a trip-free, two-link switch-operating mechanism 200 provided according to the invention The mechanism includes a switch having a fixed contact 202 and a movable contact 204, shown in an open-contact position. The movable contact 204 of the switch is coupled through a revolute joint 206 to one end of a switch lever arm 208A, which is the first link of a two-link, trip-free mechanism according to the invention. The switch lever arm 208A corresponds to the diagrammatic switch arm link 106, which was shown and described in connection with FIGS. 2A, 2B, and 2C. The switch lever arm 208A is mounted for pivotal movement to a fixed revolute joint 210. On the side of the switch lever arm, or link, 208A is shown a connection post 218 to which is hooked one end of a return spring 220A. The other end of the return spring 220A is hooked to a fixed support member 222A.

At the other end of the switch lever arm 208A is mounted a roller 212. The roller 212 is mounted for rotation on a shaft 213, Which is supported between a pair of support brackets 214A, 214B.

FIG. 3 shows the roller 212 mounted between the pair of support brackets 214A, 214B, which are rigidly connected to a connecting transverse bar 216. The support brackets 214A, 214B, the transversal bar 216, the switch lever arm link 208A, and two additional switch lever arm links 208B and 208C are all rigidly connected through the transverse bar 216. Note that for a three-phase circuit-breaker system, the transverse bar 216 extends between the three switch lever arms 208A, 208B, and 208C to transfer a closing motion or an opening motion to each of the switch lever arms, simultaneously.

One difference between the diagrammatic illustration shown in FIGS. 2A, 2B, and 2C and the embodiment of the invention shown in FIGS. 3 through 8 is the physical shape of the two links provided by the embodiment of FIGS. 3 through 8 as compared to the shape of the links of FIGS. 2A, and 2B. The link 116, as shown in FIGS. 2A, 2B, and 2C, is an elongated bar member, which is connected to the movable support 136 by means of the revolute joint 134. The link 116 has a semi-circular cam surface formed on its other end 132 for engagement with the roller 130 mounted to the end of the switch arm 106. The element corresponding to the link 116 in the more detailed embodiment of the invention described hereinafter is implemented as a cam member mounted for rotary motion on a shaft.

FIG. 4 shows a main cam member 230 fixed to a shaft 232 for rotational movement around the axis of the shaft 232. This main cam member 230 has an external cam surface 234 with a concave region 236 formed on a portion thereof. FIG. 4 shows the main cam 230 rotated to a position in which the roller 212 engages the concave region 236 of the cam surface 234.

FIG. 3 is a frontal elevation view of the switch-operating mechanism assembly 200. This view shows a pair of arms 240A, 240B which are respectively and rigidly connected on opposite ends to the shaft 232 on which the main cam 230 is rigidly mounted. Each of these arms 240A, 240B has a post 242 mounted near its distal end. Each of these posts respectively functions as a connection point for a hooked end of a driving spring 244A and 244B. The other hooked end of each of the driving springs 244A, 244B engages a respective end of a shaft 246. FIG. 3 shows each one of the pair of driving springs 244A, 244B. FIG. 3 also shows the pair of return springs 220A, 220B. For each of these pairs, one spring is used on each side of the mechanism to better balance the distribution of the forces applied to the mechanism of the assembly.

Referring to FIGS. 3 and 4, on one side of the main cam 230 is mounted a roller 250, which is shown engaged against one end of a closing cam 252. The other end of the closing cam 252 is rigidly connected to one end of a lever 254. The other end of the closing cam 252 and the one end of the lever 254 are mounted for pivotal movement about a shaft 256. The other end of the lever 254 is connected to the plunger 266 of a solenoid 258 by a link 260. Engagement of the roller 250 against the end of the closing cam 252 prevents the main cam 230 from rotating clockwise. A clockwise torque on the main cam 230 is caused by forces from the closing springs 244A, 244B. FIG. 3 and FIG. 4 show the closing springs 244A, 244B in their extended, or charged, positions.

It is important to notice that during the charging of the driving springs, posts 242 rotate passing toggle point A: This toggle point is defined by the lower intersection of the arc rotation of post 242 around axes of shaft 232 and the imaginary line connecting axes of shaft 232 and axes of shaft 246. If the main cam 230 is rotated clockwise so that the post 242 is moved past toggle point A, a previously mentioned clockwise torque is provided by the springs 244A, 244B on the main cam 230.

FIG. 3 and 4 show an electrical motor 270 with an arm 272 fixed to its shaft. A roller 274 is mounted to the end of the arm 272 and is engaged within a slot 276, which is formed in one end of a ratchet arm 278. Rotation of the shaft of the motor 270 causes the ratchet arm 278 to move left and right. The other end of the ratchet arm 278 engages with a ratchet gear mechanism 279, turns the main shaft 232, the main cam 230, and arms 240A and 240B in a clockwise direction to charge the driving springs 244A, 244B using the motor 270, as described hereinafter.

FIGS. 3 and 4 show two rollers 280A and 280B which are mounted to a shaft 283. These rollers 280A, 280B are engaged by trip latch arms 282A and 282B which are rotatably mounted on a shaft 284, which is mounted to a fixed support 286. One end of a link 288 is coupled to the trip latch arms 282A, 282B. The other end of the link 288 is connected to the plunger 290 of a solenoid 292. When the solenoid 292 is energized, the plunger 290 moves upwardly, pulling the link 288 to rotate the trip latch arms 280A, 280B counterclockwise.

Referring to FIG. 3, a fixed support means for the entire switch-operating mechanism 200 includes fixed support panels 300A and 300B on which shaft 246 is mounted.

Also referring to FIG. 3, a fixed-movable support structure for the main cam 230 includes two side plates 304A and 304B, which are mounted by rotary bearings 306A and 306B to the shaft 246 for pivotal movement about that shaft. These two sides plates 304A, 304B have bearings 308A and 308B fixed thereto for rotationally supporting the shaft 232 to which the main cam 230 is attached. Bearings 309A and 309B are mounted to the side plates 304A, 304B for supporting the shaft 256, to which the closing cam 252 is mounted for rotation. The shaft 283 for mounting the trip rollers 280A, 280B is also mounted to the side plates 304A, 304B. This movable support structure formed with the two side plates 304A, 304B, can rotate about the shaft 246, by bearings 306A, 306B where the shaft 246 is mounted on the two fixed support panels 300A, 300B of the fixed support means.

OPENING AND CLOSING SEQUENCES

Having described the components of this specific embodiment of a two-link, trip-free switch-operating mechanism according to the invention, attention is directed to the closing and opening sequences for such a mechanism.

CLOSING SEQUENCE

FIG. 4 shows the assembly 200 in a configuration in which its switch contacts are open with the driving springs 244A, 244B in their charged configuration. Solenoid 258 is electrically energized to pull the link 260 upward. This forces the free left end of lever 254 to move upwardly and to rotate clockwise on the shaft 256 together with the closing cam 252. This clockwise rotation disengages the end of the closing cam 252 from the roller 250, which is mounted to the main cam 230. The main cam 230 is now free to rotate clockwise because of the biasing torque generated by driving springs 244A, 244B, as previously discussed. The roller 212 mounted to the switch arm link 208 rides along the contoured cam surface 234 of the main cam 230. As the main cam 230 starts to rotate clockwise, the roller 212 rides to higher points of the cam profile so that the roller 212 is pushed downwardly. This causes the switch arm link 208 to rotate clockwise relative to its fixed revolute support 210. The other end of the switch arm link 208 therefore moves upwardly to push the movable contact 204 of the switch to its closed position next to the fixed contact 202.

It is important to notice that while the main cam 230 rotates clockwise during the closing sequence, the connection points 218A and 218B of the opening springs 220A, 220B on the switch lever arms 208 move downwardly to further extend the opening springs 220A, 220B and further increase the stored energy of these springs.

Figure 5:
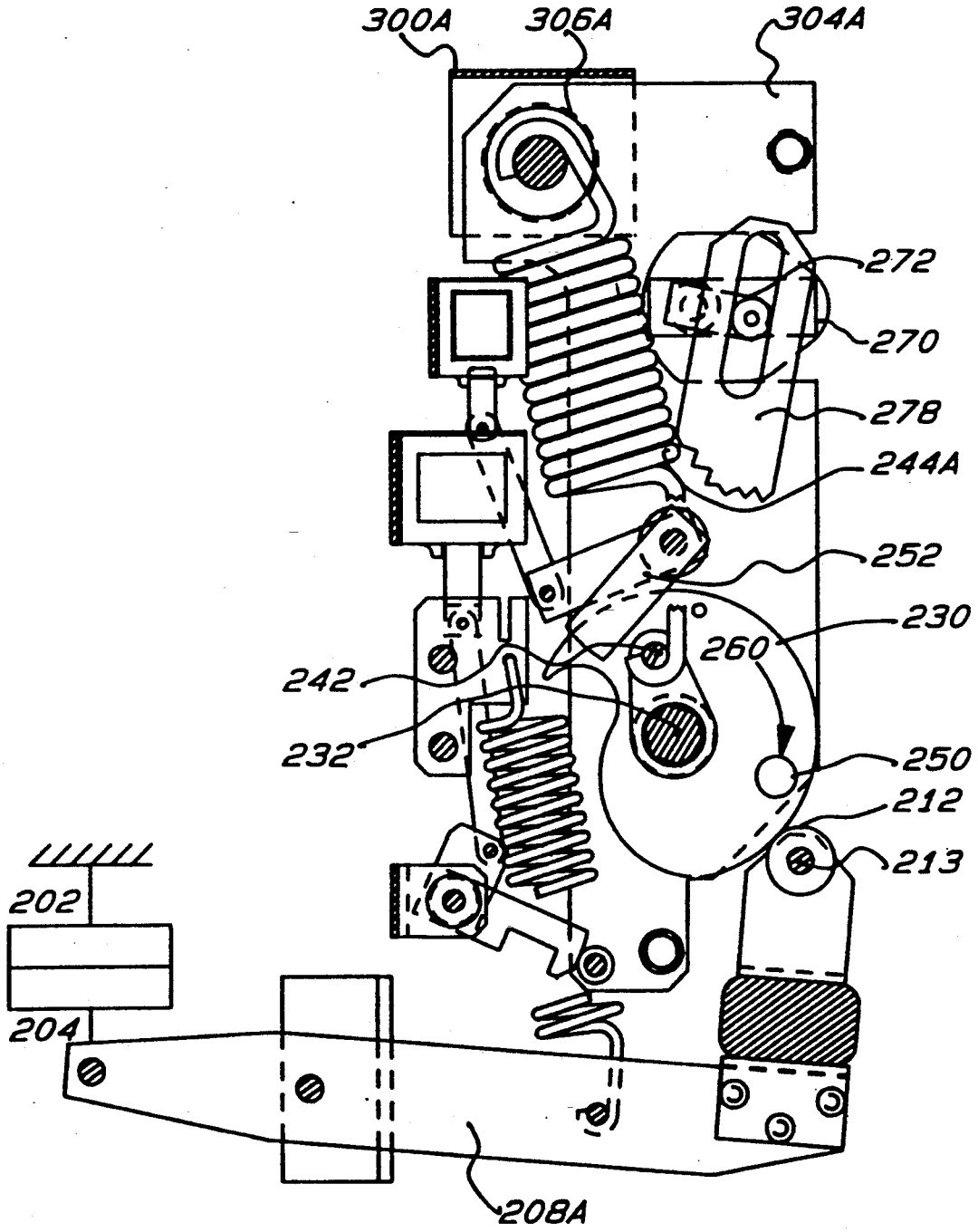
FIG. 5 is a side elevation view of the embodiment of the circuit breaker of FIG. 3 with the mechanism and contacts being shown in their closed position and with the driving springs in a de-energized state.

FIG. 5 shows the main cam 230 stopped in its rotation in a position where the connection post 242 for the closing springs 220A, 220B is in its second toggle point B opposite to toggle point A previously discussed. At this point, a suitable limit switch (not shown) starts the motor 270 to begin recharging the driving springs 244A, 244B. FIG. 5 illustrates the switch-operating mechanism with its switch contacts 202, 204 closed and with its driving springs 244A, 244B discharged.

For purposes of completeness, it should be added that the mechanism is provided with means 320 shown in FIG. 3 for manually charging the closing springs 244A, 244B.

The motor 270 rotates the arm 272 which causes the ratchet arm 278 and ratchet gear mechanism 279 (shown in FIG. 3) to rotate the shaft 232 clockwise. This rotation forces the posts 242A, 242B to rotate clockwise, in accordance with the reference arrow 260 in FIG. 5. Rotation of the point of attachment provided by the posts 242A, 242B for the springs 244A, 244B extends the driving springs 244A, 244B. As soon as the post 242 rotates past toggle point A, the limit switch stops the motor 270.

Figure 6:
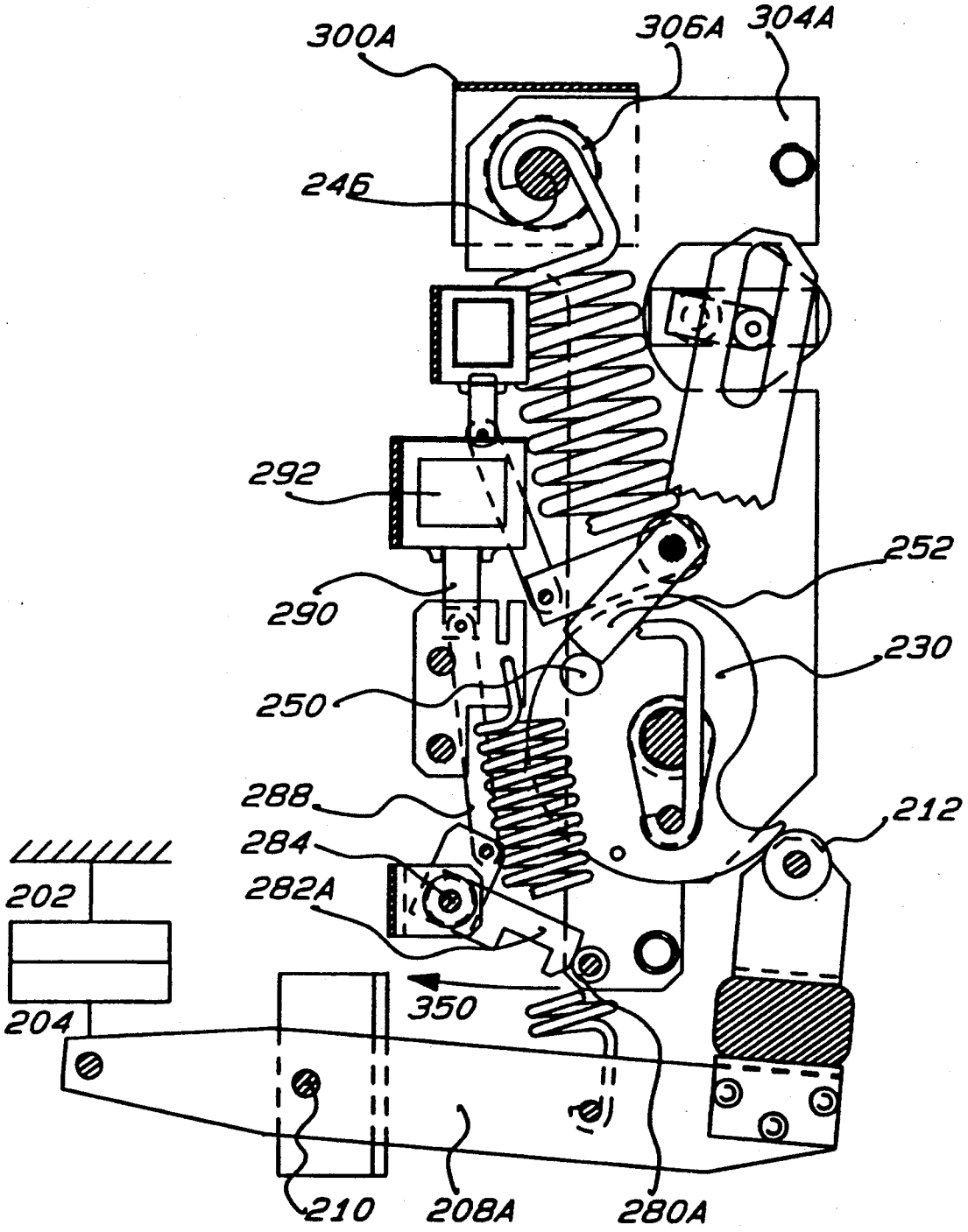
FIG. 6 is a side elevation view of the embodiment of the circuit breaker of FIG. 3 with the mechanism and contacts being shown in their closed position and with the driving springs in a energized state.

FIG. 6 shows that, once the post 242 passes toggle point A, the roller 250 mounted on the side of the main cam 230 engages against the end of the closing cam 252. The closing cam 252 has been returned back to its original position by means of a biasing spring, not shown. The latching stops the clockwise rotation of the main cam 230 and ends the charging sequence for the driving springs 244A, 244B. During the sequence for charging the driving springs 244A, 244B, the roller 212 at the end of the switch arms 208A, 208B, and 208C rides on the cam surface of the main cam 230 which is now an arc with center on the axes of shaft 232, causing the switch contacts 202, 204 to remain closed.

SWITCH OPENING SEQUENCE - SECOND TRIP FREE STATUS

Back to FIG. 5, the switch-operating mechanism is shown in the state where the switch contacts 202, 204 are closed and the driving springs 244A, 244B are discharged. To initiate the opening sequence, the opening solenoid 292 is energized to pull the plunger 290 and link 288 upwardly. This forces the opening cam members 282A, 282B to rotate counterclockwise on shaft 284 so that the cam members 282A, 282B disengage from the rollers 280A, 280B. Note that the fixed-movable support structure formed with the two side plates 304A, 304B can rotate about the shaft 246 by bearings 306A, 306B mounted on the two fixed support panels 300A, 300B. At this point, the now movable support structure is free to rotate in a clockwise direction, in accordance with the reference arrow 350, on the bearings 306A, 306B. The roller cam 212 at the other end of the switch arm 208 exerts a force on the main cam 230, where the force is produced by the opening springs 220A, 220B. As previously disclosed, the opening springs 220A, 220B generate a switch-opening torque opposite in direction to the clockwise switch-closing movement of switch arm links 208A and 208B. When the switch-closing mechanism is in its closed-contact configuration, the switch-opening torque is at its greatest value, corresponding to the maximum extension of the opening springs 220A, 220B.

Figure 7:
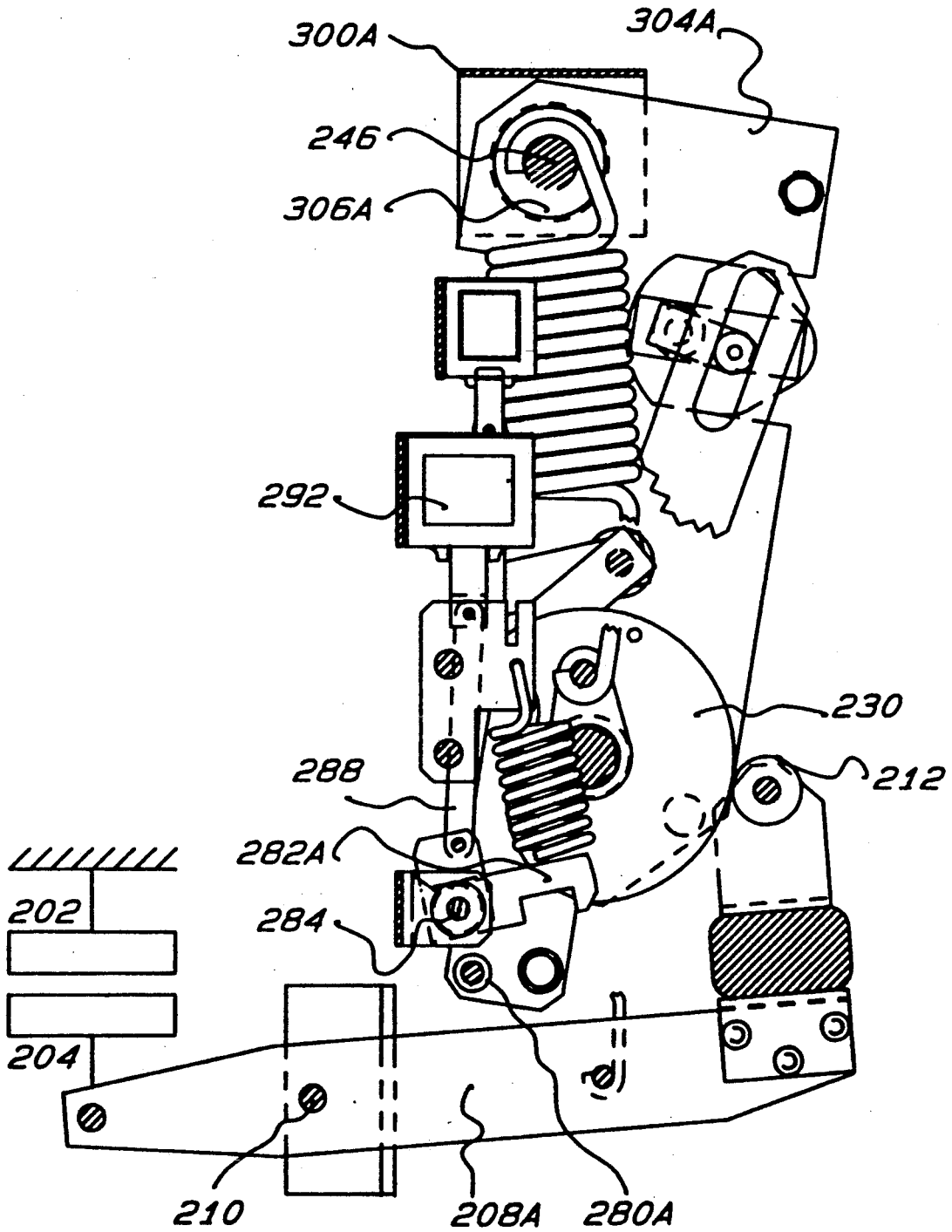
FIG. 7 is a side elevation view of the embodiment of the circuit breaker of FIG. 3 with the mechanism and contacts being shown in their open position and with the driving springs in a de-energized state.

FIG. 7 shows that the roller 212 engages the cam surface of the main cam 230 so that the movable support structure provided by the two side plates 304A, 304B and with the main cam 230 mounted thereto is pushed by the roller 212 and rotates in a clockwise direction about the shaft 246. When the opening cam members 282A, 282B disengage the rollers 280A, 280B, the main cam 230 moves to the left as it is pushed by the roller 212. The roller 212 moves upwardly as the switch arm links 208A, 208B, 208C to which the rollers 212 is mounted, rotate about the joint 210. This disengages the roller from exerting a force on the main cam. The other ends of the switch arm links with the switch contact 204 coupled thereto are pulled downwardly so that the switch is in an open-contact state.

Figure 8:
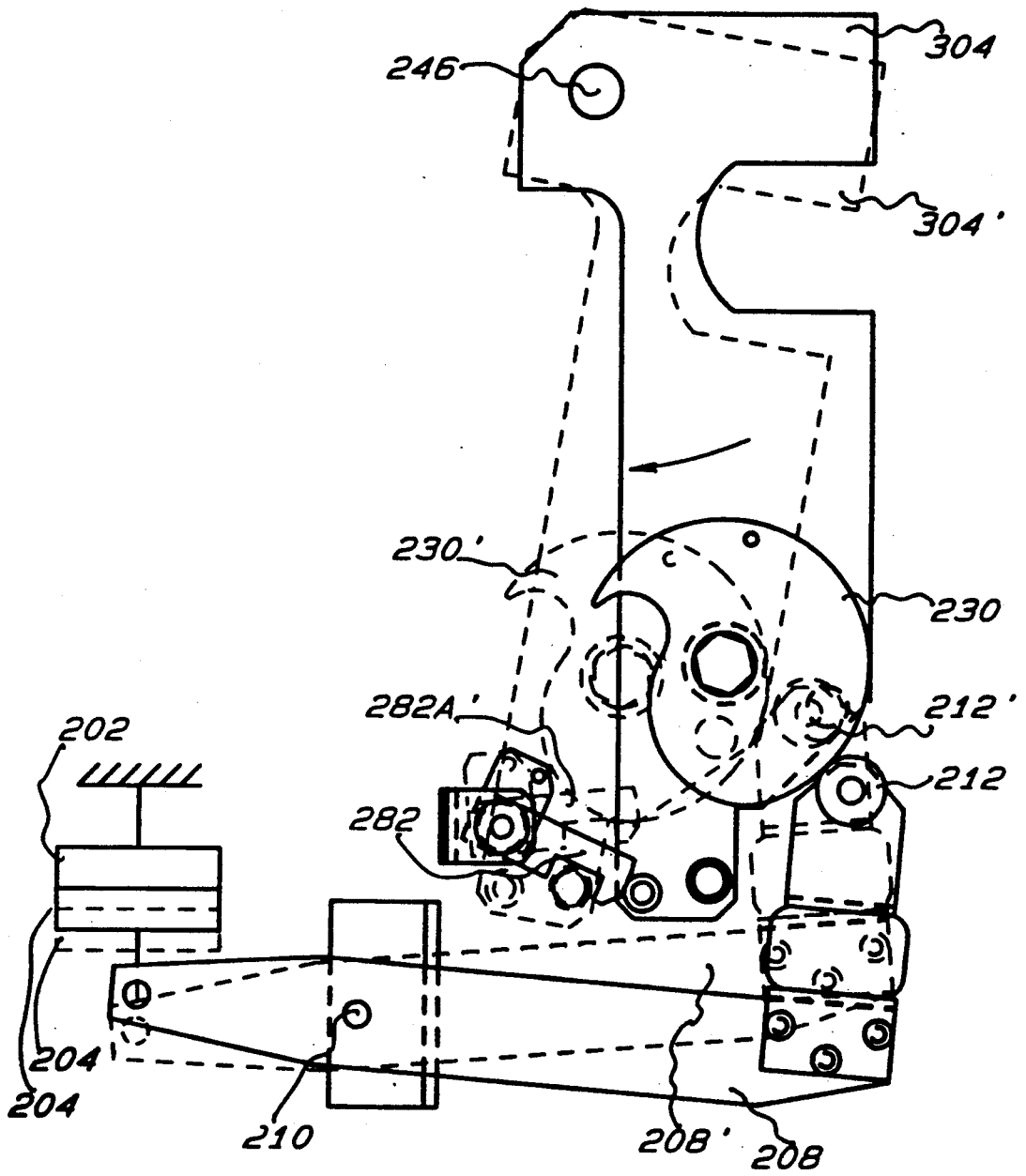
FIG. 8 is a side elevation view of the embodiment of the circuit breaker of FIG. 3 showing the pivotal support member for the main cam in two pivot positions.

FIG. 8 shows, in solid lines, the side plate 304A in the non-tripped position, where the opening cam member 282A is engaged with the roller 280A and the roller 212 engages the cam 230 to close the switch contacts 202,204. The dotted lines show these elements in the tripped position, where the opening cam member 282A does not engage the roller 280A and the switch contacts are opened.

Referring back to FIG. 7 the roller 212 is shown engaging cam surface 234 of the main cam 230. Once the charging of the Driving Spring is completed, the main cam 230 shows its concavity 236 to roller 212. Biasing forces, not shown, force the support structure to rotate counterclockwise to its original position as shown in FIG. 4, with roller 212 fully engaged in concavity 236 of main cam 230. At this point opening cams 282A, 282B are rotated back to their original position due to the force of gravity and appropriate spring not shown.

FIG. 4 shows the switch-operating mechanism assembly in a configuration where the switch contacts are open and the driving springs 220A, 220B are recharged. The mechanism is thus ready to initiate another switch-closing sequence.

It should be evident that a trip-free switch-opening sequence can be initiated at any time during a switch-closing sequence for the mechanism. The opening solenoid 292 can be energized at any time so that the and the opening cams 282A, 282B can be disengaged from the opening rollers 280A, 280B. This lets the supporting structure rotate clockwise and open the switch contacts. As previously mentioned, this type of operation is called trip-free. As disclosed hereinabove, the invention provides a simple, two-link, trip-free switch operating mechanism.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

I claim:

1. A two-link, trip-free operating mechanism for use in a switch assembly including switch means movable between a tripped, or open, state and a closed state, said mechanism comprising:

a first link member comprising a switch level arm having a switch end coupled to said switch means for moving said switch means between said tripped state and said closed state, said switch lever arm having a cam-follower means mounted thereto;

means for supporting said switch lever arm for pivotal movement about a first fixed point and between a switch-closed position and a switched-opened position;

biasing means for biasing the switch end of said lever arm to is switch-open position to place said switch means in said tripped state;

a second link member having a cam member rotatably mounted thereto, said cam member being engageable with the cam-follower means mounted to said switch lever arm and being rotatable to various positions to move the cam-follower means and to control the state of said switch means between said tripped state and said closed state; and to maintain said switch means in said tripped state or in said closed state;

means, to which said second link is pivotably mounted, for supporting said second link for pivotal movement about a second pivot point;

releasable means for translating the second pivot point for the second link and for selectively engaging and disengaging the cam portion and the cam-follower means, said releasable means having a first engaged position in which the cam portion of the switch lever arm is coupled to the cam-follower mounted to said switch lever arm, said releasable means having a second released position in which the cam portion of the switch lever arm is uncoupled from the cam-follower mounted to the switch lever arm and in which the biasing means holds the lever arm in its switch-opened position to thereby maintain the switch means in its tripped, or open, state, independent of the rotational position of said cam member.

2. A two-link, trip-free switch assembly, comprising:

switch means (102,104/202,204) movable between an opened state and a closed state;

a switch lever arm assembly including a first link member comprising a switch lever arm (106/208) with a first end coupled to said switch means and with a second end having a cam follower (130/212) mounted thereto, said switch lever arm assembly including means (110/210) for supporting said switch lever arm for pivotal movement about a fixed first axis between a switch-closed position, in which said switch means is in the closed and a switch-opened position in which said switch means is in the opened sate;

means (150/220) for biasing the switch lever arm toward the switch-opened position;

a second link member comprising a rotatable main cam member (116/230) having limited rotation and having a cam surface for engagement with the cam follower mounted on said switch lever arm;

movable support means (136/304) for supporting said main cam member for rotation about a movable second axis, said movable support means movable between a first fixed position and a second tripped position;

tripping latch means (160/282,280) for holding said movable support means in said first fixed position and in said second tripped position, said first fixed position causing the main cam member to engage said cam follower, said second tripped position causing said cam follower to be released from engagement with the main cam member permitting the means for biasing the switch lever arm to pivot the switch lever arm to the switch-position so that the circuit breaker contacts are opened, independent of the rotational position of the main cam member.

3. The switch assembly of claim 2 wherein saied movable support means includes pivotal support means (134/304), for supporting said rotatable main cam member for pivotal movement about said movable second axis, said pivotal support means having a first fixed position in which the cam surface of said main cam member engages said cam follower, said pivotal support means having a second tripped position in which the cam surface of said main cam member does not engage said cam follower mounted on the switch lever arm.

4. The switch assembly of claim 2 wherein said rotatable main cam member includes removable restraint means (154/250,252) for restraining the main cam member from rotating from a first cam position to a second cam position in which first cam position the main cam member contacts the cam follower with the switch lever arm being in the switch-opened position and in which second cam position the main cam member contacts the cam follower with the switch lever arm being in the switch switch-closed position.

5. The switch assembly of claim 2 wherein said means for biasing includes spring means (220).

6. A two-link, trip-free operating mechanism assembly for a switch, comprising:

switch means movable between an opened state and a closed state;

a first link comprising a switch lever arm assembly having a switch lever arm with a first end coupled to said switch means and with a second end having a cam follower mounted thereto, said assembly having means for supporting said switch lever arm for pivotal movement about a first fixed axis between a switch-closed position and a switch-opened position;

means for biasing the switch lever arm toward the switch-opened position;

a second link assembly including support means for supporting a second link member for pivotal movement about a movable axis, said second link assembly including a main cam member rotatably mounted to said second link member, said main cam member engageable with the cam follower mounted to the switch lever arm;

latch means for selectively holding said second link member in a first fixed position and in a second tripped position;

wherein, in the first fixed position, the main cam member engages the cam follower and the main cam member is selectively rotatable to certain rotational positions in which the cam-follower causes the switch means to be in the opened state and the closed state; and wherein, the second tripped position, the cam member and the cam-follower are disengaged and the switch means are placed in the opened state, independent of the rotational position of the main cam member, whereby the operating mechanism provides trip-free operation.

* * * * *

UNITED STATES PATENT AND TRADEMARK OFFICE

CERTIFICATE OF CORRECTION

PATENT NO. : 5,140,117

DATED : August 18, 1992

INVENTOR(S) : Vianson

It is certified that error appears in the above-identified patent and that said Letters Patent is hereby corrected as shown below:

On the cover page at [73] Assignee, both joint Assignees of record as of the date of Issuance should be listed.

After the word Assignee at [73], the cover page should read
PMC Engineering Company, Inc.,
Livermore, Calif.

--and
Goldstar Instrument & Electric Co. Ltd.,
Seoul, Korea--

Signed and Sealed this

First Day of February, 1994

Bruce Lehman

*Attest:*

BRUCE LEHMAN

*Attesting Officer*

*Commissioner of Patents and Trademarks*